United States Patent [19]

Hiraishi et al.

[11] Patent Number: 4,965,237

[45] Date of Patent: Oct. 23, 1990

[54] THERMAL PRINTING MATERIAL

[75] Inventors: Shigetoshi Hiraishi, Tokyo; Kazuo Kabashima, Yokohama, both of Japan

[73] Assignees: Mitsubishi Paper Mills, Ltd., Tokyo; Asahi Kasei Kogyo Kabushiki Kaisha, Osaka, both of Japan

[21] Appl. No.: 146,828

[22] PCT Filed: May 13, 1987

[86] PCT No.: PCT/JP87/00300

§ 371 Date: Dec. 31, 1987

§ 102(e) Date: Dec. 31, 1987

[87] PCT Pub. No.: WO87/06885

PCT Pub. Date: Nov. 19, 1987

[30] Foreign Application Priority Data

| | | | |
|---|---|---|---|
| May 14, 1986 | [JP] | Japan | 61-108670 |
| Sep. 10, 1986 | [JP] | Japan | 61-211692 |
| Sep. 10, 1986 | [JP] | Japan | 61-211693 |
| Nov. 11, 1986 | [JP] | Japan | 61-266695 |
| Nov. 12, 1986 | [JP] | Japan | 61-267697 |
| Feb. 6, 1987 | [JP] | Japan | 62-24668 |
| Apr. 17, 1987 | [JP] | Japan | 62-93258 |

[51] Int. Cl.[5] ..... B41M 5/18

[52] U.S. Cl. ..... 503/209; 503/208; 503/216; 503/217; 503/225

[58] Field of Search ..... 427/150–157; 503/208, 209, 216, 217, 225

[56] References Cited

U.S. PATENT DOCUMENTS 4,521,793 6/1985 Kabishima et al. ..... 503/201

*Primary Examiner*—Bruce H. Hess

*Attorney, Agent, or Firm*—Cushman, Darby & Cushman

[57] ABSTRACT

This invention relates to a thermal printing material comprising a substrate and a thermal printing layer formed thereon containing an aromaticity-possessing isocyanate compound, an imino compound having at least one>C=NH group which reacts with said aromaticity-possessing isocyanate compound on heating to produce color, and one or more aniline derivatives having at least one amino group, said thermal printing layer being intended to improve the image storage properties, in particular, the storage properties of color-undeveloped portion (ground), and it can be utilized in recorders for measurements, facsimiles, printers, terminals of computers, labels, and automatic ticket vending machines.

14 Claims, No Drawings

THERMAL PRINTING MATERIAL

TECHNICAL FIELD

This invention relates to a thermal printing material comprising a substrate and a specific thermal printing layer formed thereon which is excellent not only in image storage properties but also in storage properties of color-undeveloped portion.

BACKGROUND ART

Thermal printing materials generally comprise a substrate and a thermal printing layer formed thereon composed mainly of an electron-donative, colorless dye precursor and an electron-attractive developer. When they are heated by means of a thermal head, a thermal pen, laser beam, or the like, the colorless dye precursor reacts with the developer in a moment to form a printed image. They are disclosed in Japanese Patent Examined Publication Nos. 43-4160 and 45-14039, etc. Such thermal printing materials are advantageous in that they permit printing by means of a relatively simple apparatus, are easy to maintain, and do not cause production of a noise, and they are used in various fields, for example, in recorders for measurements, facsimiles, printers, terminals of computers, labels, and vending machines for tickets and the like.

Such thermal printing materials using an electron-donative, colorless dye precursor and an electron-attractive developer have various excellent characteristics, for example, they have a good appearance, are good to the touch, show a high depth of developed color, and can give various hues of developed color. But they are disadvantageous in that they are poor in print storage properties, for example, a thermally color-developed portion (a printed image portion) is lost owing to plasticizers, additives, etc. contained in plastics such as poly(vinyl chloride) when brought into contact with plastics, or is easily lost when brought into contact with chemicals contained in foods or cosmetics, or is easily faded by exposure to the sunlight for a short period of time. In the existing circumstances, because of this disadvantage, they are limited in uses to a considerable degree and are eagerly desired to be improved.

Further, in recent years, a high-speed printer capable of printing in a short time has been developed, and there has come to be required a highly sensitive thermal printing material suitable therefor which is excellent in response to heat and can give a sufficient developed color image even at a low energy.

As thermal printing materials in which two components react with each other on heating to give a printed image good in storage properties, those in which the two components are an imino compound and an isocyanate compound are disclosed, for example, in Japanese Patent Unexamined Publication Nos. 58-38733, 58-54085, 58-104959, 58-149388, 59-115887 and 59-115888, the specification of U.S. Pat. No. 4,521,793.

DISCLOSURE OF THE INVENTION

These thermal printing materials are excellent in print storage properties but are disadvantageous in that a plasticizer, etc. adheres to their non-image portion (the ground), so that the ground undergoes color development.

In order to obtain a thermal printing material which is excellent not only in image storage properties but also in storage properties of non-image portion, the present inventors have devoted themselves to research and have consequently found that a thermal printing material comprising a substrate and a thermal printing layer formed thereon comprising an aromaticity-possessing isocyanate compound, an imino compound having at least one >C=NH group which reacts with said aromaticity-possessing isocyanate compound on heating to produce color, and one or more aniline derivatives having at least one amino group, has excellent characteristics in the above points which cannot be attained by use of a conventional color producing agent system alone, whereby this invention has been accomplished.

This invention is characterized particularly in that one or more aniline derivatives having at least an amino group is contained as a third component in the thermal printing layer, and as the aniline derivatives, those having the general formulas shown below are preferably used.

First, there are compounds represented by the general formula (I):

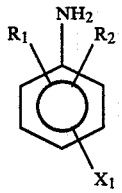

wherein each of $R_1$ and $R_2$ is hydrogen, an alkyl group, an alkoxyl group, a halogen or an amino group; and $X_1$ is

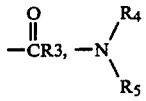

or $—SO_2R_6$ in which $R_3$ is a substituted or unsubstituted alkoxyl group, an aryl group, an alkyl group, a substituted or unsubstituted amino group, or a substituted or unsubstituted anilino group, and each of $R_4$ and $R_5$ is hydrogen, an alkyl group, or

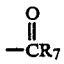

(wherein $R_7$ is an alkyl group or an aryl group). In particular, examples of these compounds include compounds represented by the general formulas (1) to (3) shown below.

Compounds represented by the general formula (1):

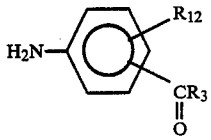

wherein $R_{12}$ is hydrogen, an alkyl group, an alkoxyl group or a halogen; and $R_3$ is a substituted or unsubstituted alkoxyl group, an aryl group, an alkyl group, a substituted or unsubstituted amino group, or a substituted or unsubstituted anilino group. In the formula, the alkyl group is preferably one which has 1 to 4 carbon atoms; the alkoxy group is preferably one which has 1 to 4 carbon atoms in the case of $R_{12}$ or 1 to 18 carbon atoms in the case of $R_3$; the halogen is preferably Cl or Br; and the substitution is preferably an aryl group, an alkyl group, a halogen or an amino group.

Specific examples of compounds as the aniline derivatives of the general formula (1) include methyl p-aminobenzoate, ethyl p-aminobenzoate, n-propyl p-aminobenzoate, iso-propyl p-aminobenzoate, butyl p-aminobenzoate, dodecyl p-aminobenzoate, benzyl p-aminobenzoate, o-aminobenzophenone, m-aminoacetophenone, p-aminoacetophenone, m-aminobenzamide, o-aminobenzamide, p-aminobenzamide, p-amino-N-methylbenzamide, 3-amino-4-methylbenzamide, 3-amino-4-methoxybenzamide, 3-amino-4-chlorobenzamide, p-(N-phenylcarbamoyl)aniline, p-[N-(4-chlorophenyl)carbamoyl]aniline, p-[N-(4-aminophenyl)-carbamoyl]aniline, 2-methoxy-5-(N-phenylcarbamoyl)-aniline, 2-methoxy-5-[N-(2'-methyl-3'-chlorophenyl)-carbamoyl]aniline, 2-methoxy-5-[N-(2'-chlorphenyl)-carbamoyl]aniline, etc.

Compounds represented by the general formula (2):

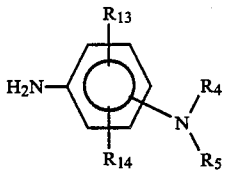

wherein each of $R_{13}$ and $R_{14}$ is hydrogen, an alkyl group or an alkoxyl group; and each of $R_4$ and $R_5$ is hydrogen, an alkyl group, or

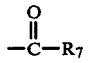

in which $R_7$ is an alkyl group or an aryl group. Each of the alkyl group and the alkoxyl group in the formula is preferably one which has 1 to 4 carbon atoms.

Specific examples of compounds as the aniline derivatives of the general formula (2) include 5-acetylamino-2-methoxyaniline, 4-acetylaminoaniline, 4-(N-methyl-N-acetylamino)aniline, 2,5-diethoxy-4-(N-benzoylamino)aniline, 2,5-dimethoxy-4-(N-benzoylamino)aniline, 2-methoxy-4-(N-benzoylamino)-5-methylaniline, etc.

Compounds represented by the general formula (3):

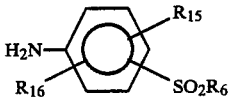

wherein $R_6$ is a substituted or unsubstituted amino group, an aryl group, a substituted or unsubstituted aryloxy group, or an aralkyl group; and each of $R_{15}$ and $R_{16}$ is hydrogen, a halogen, an alkyl group or an alkoxyl group. In the formula, each of the alkyl group and the alkoxyl group is preferably one which has 1 to 4 carbon atoms; the halogen is preferably Cl or Br; and the substitution is preferably an alkyl group, an aryl group, a heterocyclic ring, or a halogen.

Specific examples of compounds as the aniline derivatives of the general formula (3) include 4-sulfamoylaniline, 3-sulfamoylaniline, 2-(N-ethyl-N-phenylaminosulfonyl)aniline, 4-dimethylaminosulfonylaniline, 4-diethylaminosulfonylaniline, sulfathiazole, 4-aminodiphenylsulfone, 2-chloro-5-N-phenylsulfamoylaniline, 2-methoxy-5-N,N-diethylsulfamoylaniline, 2,5-dimethoxy-4-N-phenylsulfamoylaniline, 2-methoxy-5-benzylsulfonylaniline, 2-phenoxysulfonylaniline, 2-(2'-chlorophenoxy)sulfonylaniline, 3-anilinosulfonyl-4-(methylaniline, etc.

There are also compounds represented by the general formula (II):

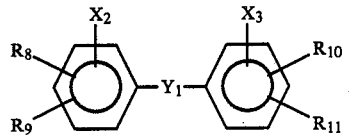

wherein each of $R_8$, $R_9$, $R_{10}$ and $R_{11}$ is hydrogen, a halogen, an alkyl group, an alkoxyl group or an amino group; each of $X_2$ and $X_3$ is an amino group, or

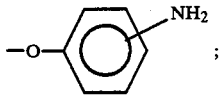

and $Y_1$ is $-SO_2-$, $-O-$, $-(S)_n-$, $-(CH_2)_n-$,

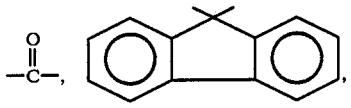

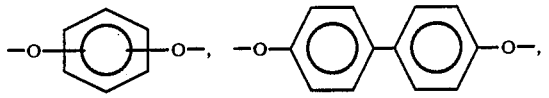

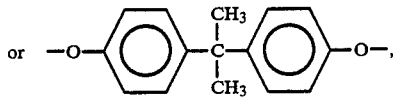

or indicates that nothing is present, n being 1 to 2. Particularly, examples of these compounds include compounds represented by the general formulas (4) to (6) shown below.

Compounds represented by the general formula (4):

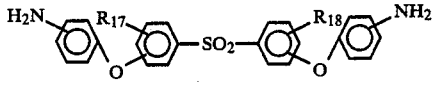

wherein each of $R_{17}$ and $R_{18}$ is hydrogen or an alkyl group. The alkyl group in the formula is preferably one which has 1 to 4 carbon atoms.

Specific examples of compounds as the aniline derivatives of the general formula (4) include bis[4-(m-aminophenoxy)phenyl] sulfone, bis[4-(p-aminophenoxy)-phenyl] sulfone, bis[3-methyl-4-(p-aminophenoxy)phenyl] sulfone, etc.

Compounds represented by the general formula (5):

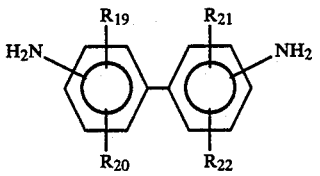

wherein each of $R_{19}$, $R_{20}$, $R_{21}$ and $R_{22}$ is hydrogen, a halogen, an alkoxyl group or an alkyl group, or $R_{19}$ and $R_{21}$, when taken together, may form a sulfonyl group. In the formula, each of the alkoxyl group and the alkyl group is preferably one which has 1 to 4 carbon atoms, and the halogen is preferably Cl or Br.

Specific examples of compounds as the aniline derivatives of the general formula (5) include 3,3'-dimethoxy-4,4'-diaminobiphenyl, 3,3'-dimethyl-4,4-diaminobiphenyl, 2,2'-dichloro-4,4'-diamino-5,5'-dimethoxybiphenyl, 2,2',5,5'-tetrachloro-4,4'-diaminobiphenyl, ortho-tolidine sulfone, 2,4'-diaminobiphenyl, 2,2'-diaminobiphenyl, 4,4'-diaminobiphenyl, 2,2'-dichloro-4,4'-diaminobiphenyl, 3,3'-dichloro-4,4'-diamino-biphenyl, 2,2'-dimethyl-4,4'-diaminobiphenyl, etc.

Compounds represented by the general formula (6):

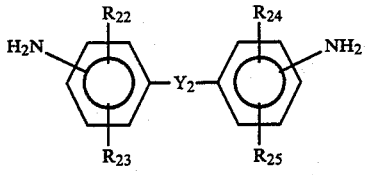

wherein each of $R_{22}$, $R_{23}$, $R_{24}$ and $R_{25}$ is hydrogen, a halogen, an alkyl group or an amino group; and $Y_2$ is —O—, $—(S)_n—$, $—(CH_2)_n—$,

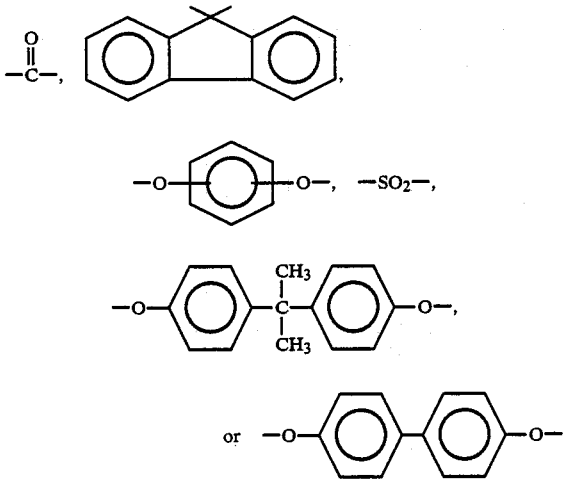

in which n is 1 or 2. In the formula, the halogen is preferably Cl or Br, and the alkyl group is preferably one which has 1 to 4 carbon atoms.

Specific examples of compounds as the aniline derivatives of the general formula (6) include 4,4'-thiodianiline, 2,2'-dithiodianiline, 4,4'-dithiodianiline, 4,4'-diaminodiphenyl ether, 3,3'-diaminodiphenyl ether, 3,4'-diaminodiphenyl ether, 4,4'-diaminodiphenylmethane, 3,4'-diaminodiphenylmethane, bis(3-amino-4-chlorophenyl) sulfone, bis(3,4-diaminophenyl) sulfone, bis(4-aminophenyl) sulfone, bis(3-aminophenyl) sulfone, 3,4'-diaminodiphenyl sulfone, 3,3'-diaminodiphenylmethane, 4,4'-ethylenedianiline, 4,4'-diamino-2,2'-dimethylbibenzyl, 4,4'-diamino-3,3'-dichlorodiphenylmethane, 3,3'-diaminobenzophenone, 4,4'-diaminobenzophenone, 1,4-bis(4-aminophenoxy)benzene, 1,3-bis(4-aminophenoxy)benzene, 1,3-bis(3-aminophenoxy)-benzene, 9,9-bis(4-aminophenyl)fluorene, 2,2-bis(4-aminophenoxyphenyl)propane, 4,4'-bis(4-aminophenoxy)-diphenyl, 3,3',4,4'-tetraaminodiphenyl ether, 3,3',4,4'-tetraaminodiphenyl sulfone, 3,3',4,4'-tetraaminobenzophenone, etc.

The aniline derivative according to this invention is added usually in an amount of 10% by weight or more based on the weight of the aromaticity-possessing isocyanate compound. Its adding amount is preferably 15 to 400% by weight, particularly preferably 20 to 200% by weight. When the adding amount of said aniline derivative is less than 10% by weight based on the weight of the aromaticity-possessing isocyanate compound, the storage properties of ground is insufficient, which when it is more than 500% by weight, an economically disadvantageous case arises and moreover the amount of heat-fusible substances is increased, resulting in dilution effect, so that no sufficient depth of developed color can be attained.

Although addition of one of the aniline derivatives according to this invention alone is effective, a large effect is synergistically produced by simultaneous addition of two or more of said aniline derivatives in some cases.

As to the aromaticity-possessing isocyanate used in this invention, the term "aromaticity-possessing isocyanate" means an aromatic isocyanate or a heterocyclic isocyanate which are colorless or light-colored and are solid at ordinary temperature, and for example, one or more of the isocyanates described below are used.

There are 2,6-dichlcrophenyl isocyanate, p-chlorophenyl isocyanate, 1,3-phenylene diisocyanate, 1,4-phenylene diisocyanate, 1,3-dimethylbenzene-4,6-diisocyanate, 1,4-dimethylbenzene-2,5-diisocyanate, 1-methoxybenzene-2,4-diisocyanate, 1-methoxybenzene-2,5-diisocyanate, 1-ethoxybenzene-2,4-diisocyanate, 2,5-dimethoxybenzene-1,4-diisccyanate, 2,5-diethoxybenzene-1,4-diisocyanate, 2,5-dibutoxybenzene-1,4-diisocyanate, azobenzene-4,4'-diisocyanate, diphenlether-4,4'-diisocyanate, naphthalene-1,4-diisocyanate, naphthalene-1,5-diisocyanate, naphthalene-2,6-diisocyanate, naphthalene-2,7-diisocyanate, 3,3'-dimethyl-biphenyl-4,4'-diisocyanate, 3,3'-dimethoxybiphenyl-4,4'-diisocyanate, diphenylmethane-4,4'-diisocyanate, diphenyldimethylmethane-4,4'-diisocyanate, benzophenone-3,3'-diisocyanate, fluorene-2,7-diisocyanate, anthraquinone-2,6-diisocyanate, 9-ethylcarbazole-3,6-diisocyanate, pyrene-3,8-diisocyanate, naphthalene-1,3,7-triisocyanate, biphenyl-2,4,4'-triisocyanate, 4,4',4''-triisocyanate-2,5-dimethoxytriphenylamine, p-dimethylaminophenyl isocyanate, tris(4-phenylisocyanate) thiophosphate, etc. These isccyanates can be used, if necessary, in the form of so-called block isocyanates which are addition compounds with phenols, lactams, oximes, etc., or in the form cf dimers of diisocyanates, e.g., dimer of 1-methylbenzene-2,4-diisocyanate, and isocyanurates which are trimers of diisocyanates, or in the form of polyisocyanates which are adducts with various polyols, etc.

As to the imino compound having at least one >C=NH group used in this invention, the term "imino compound having at least one >C=NH group" means a compound represented by the general formula $$\phi \qquad C{=}NH$$

(wherein $\phi$ is an aromaticity-possessing compound residue capable of forming a conjugated system with the adjacent C=N) which is solid at ordinary temperature and is colorless or light-colored. Specific examples thereof are given below. It is also possible to use two or more imino compounds simultaneously depending on purposes.

There are 3-iminoisoindolin-1-one, 3-imino-4,5,6,7-tetrachloroisoindolin-1-one, 3-imino-4,5,6,7-tetrabromoisoindolin-1-one, 3-imino-4,5,6,7-tetrafluoroisoindolin-1-one, 3-imino-5,6-dichloroisoindolin-1-one, 3-imino-4,5,7-trichloro-6-methoxy-isoindolin-1-one, 3-imino-4,5,7-trichloro-6-methylmercaptoisoindolin-1-one, 3-imino-6-nitroisoindolin-1-one, 3-imino-isoindoline-1-spiro-dioxolan, 1,1-dimethoxy-3-imino-isoindoline, 1,1-diethoxy-3-imino-4,5,6,7-tetrachloroisoindoline, 1-ethoxy-3-imino-isoindoline, 1,3-diiminoisoindoline, 1,3-diimino-4,5,6,7-tetrachloroisoindoline, 1,3-diimino-6-methoxyisoindoline, 1,3-diimino-6-cyanoisoindoline, 1,3-diimino-4,7-dithia-5,5,6,6-tetrahydroisoindoline, 7-amino-2,3-dimethyl-5-oxopyrrolo[3,4b]pyrazine, 7-amino-2,3-diphenyl-5-oxopyrrolo[3,4b]pyrazine, 1-iminonaphthalic acid imide, 1-iminodiphenic acid imide, 1-phenylimino-3-iminoisoindoline, 1-(3'-chlorophenylimino)-3-iminoisoindoline, 1-(2',5'-dichlorophenylimino)-3-iminoisoindoline, 1-(2',4',5'-trichlorophenylimino)-3-iminoisoindoline, 1-(2'-cyano-4'-nitrophenylimino)-3-iminoisoindoline, 1-(2'-chloro-5'-cyanophenylimino)-3-iminoisoindoline, 1-(2',6'-dichloro-4'-introphenylimino)-3-iminoisoindoline, 1-(2',5'-dimethoxyphenylimino)-3-iminoisoindoline, 1-(2',5'-diethoxyphenylimino)-3-iminoisoindoline, 1-(2'-methyl-4'-nitrophenylimino)-3-iminoisoindoline, 1-(5'-chloro-2'-phenoxyphenylimino)-3-iminoisoindoline, 1-(4'-N,N-dimethylaminophenylimino)-3-iminoisoindoline, 1-(3'-N,N-dimethylamino-4'-methoxyphenylimino)-3-iminoisoindoline, 1-(2'-methoxy-5'-N-phenylcarbamoylphenylimino)-3-iminoisoindoline, 1-(2'-chloro-5'-trifluoromethylphenylimino)-3-iminoisoindoline, 1-(5',6'-dichlorobenzothiazolyl-2'-imino)-3-iminoisoindoline, 1-(6'-methylbenzothiazolyl-2'-imino)-3-iminoisoindoline, 1-(4'-phenylaminophenylimino)-3-iminoisoindoline, 1-(p-phenylazophenylimino)-3-iminoisoindoline, 1-(naphthyl-1'-imino)-3-iminoisoindoline, 1-(anthraquinone-1'-imino)-3-iminoisoindoline, 1-(5'-chloroanthraquinone-1'-imino)-3-iminoisoindoline, 1-(N-ethylcarbazolyl-3'-imino)-3-iminoisoindoline, 1-(naphthoquinone-1'-imino)-3-iminoisoindoline, 1-(pyridyl-4'-imino)-3-iminoisoindoline, 1-(benzimidazolone-6'-imino)-3-iminoisoindoline, 1-(1'-methylbenzimidazolone-6'-imino)-3-iminoisoindoline, 1-(7'-chlorobenzimidazolone-5'-imino)-3-iminoisoindoline, 1-(benzimidazolyl-2'-imino)-3-iminoisoindoline, 1-(benzimidazolyl-2'-imino)-3-imino-4,5,6,7-tetrachloroisoindoline, 1-(2',4'-dinitrophenylhydrazone)-3-iminoisoindoline, 1-(indazolyl-3'-imino)-3-iminoisoindoline, 1-(indazolyl-3'-imino)-3-imino-4,5,6,7-tetrabromoisoindoline, 1-(indazolyl-3'-imino)-3-imino-4,5,6,7-tetrafluoroisoindoline, 1-(benzimidazolyl-2'-imino)-3-imino-4,7-dithiatetrahydroisoindoline, 1-(4',5'-dicyanoimidazolyl-2'-imino)-3-imino-5,6-dimethyl-4,7-pyraziisoindoline, 1-(cyanobenzoylmethylene)-3-iminoisoindoline, 1-(cyanocarbonamidomethylene)-3-iminoisoindoline, 1-(cyanocarbomethoxymethylene)-3-iminoisoindoline, 1-(cyanocarboethoxymethylene)-3-iminoisoindoline, 1-(cyano-N-phenylcarbamoylmethylene)-3-iminoisoindoline, 1-[cyano-N-(3'-methylphenyl)-carbamoylmethylene]-3-iminoisoindoline, 1-[cyano-N-(4'-chlorophenyl)-carbamoylmethylene]-3-iminoisoindoline, 1-[cyano-N-(4'-methoxyphenyl)carbamoylmethylene]-3-iminoisoindoline, 1-[cyano-N-(3'-chloro-4'-methylphenyl)-carbamoylmethylene]-3-iminoisoindoline, 1-[cyano-p-nitrophenylmethylene)-3-iminoisoindoline, 1-(dicyanomethylene)-3-iminoisoindoline, 1-(cyano-1',2',4'-triazolyl-(3')-carbamoylmethylene)-3-iminoisoindoline, 1-(cyanothiazoyl-(2'-carbamoylmethylene)-3-iminoisoindoline, 1-(cyanobenzimidazolyl-(2')-carbamoylmethylene)-3-iminoisoindoline, 1-(cyanobenzothiazolyl-(2')-carbamoylmethylene)-3-iminoisoindoline, 1-[(cyanobenzimidazolyl-2')-methylene]-3-iminoisoindoline, 1-[(cyanobenzimidazolyl-2')-methylene]-3-imino-4,5,6,7-tetrachloroisoindoline, 1-[(cyanobenzimidazolyl-2')-methylene]-3-imino-5-methoxyisoindoline, 1-[(cyanobenzimidazolyl-2')-methylene]-3-imino-6-chloroisoindoline, 1-[(1'-phenyl-3'-methyl-5'-oxo)-pyrazolidene-4']-3-iminoisoindoline, 1-[(cyanobenzimidazolyl-2')-methylene]-3-imino-4,7-dithiatetrahydroisoindoline, 1-[(cyanobenzimidazolyl-2')-methylene]-3-imino-5,6-dimethyl-4,7-pyraziisoindoline, 1-[(1'-methyl-3'-n-butyl)-barbituric acid-5']-3-iminoisoindoline, 3-imino-1-sulfobenzoic acid imide, 3-imino-1-sulfo-6-chlorobenzoic acid imide, 3-imino-1-sulfo-5,6-dichlorobenzoic acid imide, 3-imino-1-sulfo-4,5,6,7-tetrachlorobenzoic acid imide, 3-imino-1-sulfo-4,5,6,7-tetrabromobenzoic acid imide, 3-imino-1-sulfo-4,5,6,7-tetrafluorobenzoic acid imide, 3-imino-1-sulfo-6-nitrobenzoic acid imide, 3-imino-1-sulfo-6-methoxybenzoic acid imide, 3-imino-1-sulfo-4,5,7-trichloro-6-methylmercaptobenzoic acid imide, 3-imino-1-sulfonaphthoic acid imide, 3-imino-1-sulfo-5-bromonaphthoic acid imide, 3-imino-2-methyl-4,5,6,7-tetrachloroisoindolin-1-one, etc.

The thermal printing material according to this invention comprises, as already described, a substrate and a thermal printing layer formed thereon.

As the substrate, although paper is mainly used, various nonwoven fabrics, synthetic resin films, laminated paper, synthetic paper, metal foils, or composite sheets obtained by combination thereof can optionally be used in addition to paper depending on purposes. The layer structure of the thermal printing layer may be either a monolayer or a multilayer structure composed of a plurality of layers. In the case of the multilayer structure, an intermediate layer may be interposed between each pair of layers. Further, a protective layer may be formed on said layer. The printing layer can be obtained by mixing a binder and the like with aqueous dispersions prepared by finely grinding each color-producing component, and coating the resulting mixture on a substrate, followed by drying. In this case, a multilayer structure may be formed, for example, by incorporating each color-producing component into each layer.

The thermal printing material according to this invention can be incorporated with heat-fusible substances in order to improve its response to heat. The heat-fusible substances include, for example, benzyl p-benzyloxybenzoate, stearic acid amide, palmitic acid amide, N-methylolstearic acid amide, β-naphthylbenzyl ether, N-stearylurea, N,N'-distearylurea, phenyl β-naphthoate, phenyl 1-hydroxy-2-naphthoate, β-naphthol (p-methylbenzyl) ether, 1,4-dimethoxynaphthalene, 1-methoxy-4-benzyloxynaphthalene, N-stearoylurea, 4-benzylbiphenyl, 1,2-di(m-methylphenoxy)-ethane, 1-phenoxy-2-(4-chlorophenoxy)ethane, 1,4-butanediol phenyl ether, dimethyl terephthalate, etc.

The heat-fusible substances described above may be used alone or a mixture thereof, and in order to attain a sufficient response to heat, they are used in an amount of preferably 10 to 300% by weight, more preferably 20 to 250% by weight based on the weight of the aromaticity-possessing isocyanate compound.

The binder used in the thermal printing material according to this invention include, for example, water-soluble-binders such as starch, hydroxyethyl cellulose, methyl cellulose, carboxymethyl cellulose, gelatin, casein, polyvinyl alcohols, denatured polyvinyl alcohols, styrene-maleic anhydride copolymers, ethylene-maleic anhydride copolymers, and the like; and water-insoluble latex binders such as styrene-butadiene copolymers, acrylonitrile-butadiene copolymers, methyl acrylate-butadiene copolymers, and the like.

In addition, the thermal printing layer can be incorporated with, for example, pigments such as diatomaceous earth, talc, kaolin, calcined kaolin, calcium carbonate, magnesium carbonate, titanium oxide, zinc oxide, silicon oxide, aluminum hydoxide, urea-formaldehyde resins, etc.; metal salts of higher fatty acids such as zinc stearate, calcium stearate, etc. and waxes such as paraffin, oxidized paraffin, polyethylenes, polyethylene oxide, stearic acid amide, castor wax, etc. for the purpose of, for example, preventing wear of a head and sticking; dispersants such as sodium dioctylsulfosuccinate, etc.; ultraviolet absorbers of benzophenone series and benzotriazole series, etc.; surfactants; and fluorescent dyes.

BEST MODES FOR CONDUCTING THE INVENTION

This invention is further explained below in more detail with reference to Examples.

EXAMPLE 1

By means of a ball mill, 15 g of 1,3-diimino-4,5,6,7-tetrachloroisoindoline was dispersed in 60 g of a 1% aqueous poly(vinyl alcohol)solution for 24 hours. On the other hand, 10g of 4,4',4''-triisocyanate-2,5-dimethoxytriphenylamine was dispersed in 40 g of a 1% aqueous poly(vinyl alcohol) solution by means of a ball mill for 24 hours. Further, 20 g of methyl p-aminobenzoate was dispersed in 80 g of a 1% aqueous poly-(vinyl alcohol) solution by means of a ball mill for 24 hours. After mixing these three dispersions, 150 g of a 40% dispersion of calcium carbonate was added, followed by adding thereto 50 g of a 30% dispersion of zinc stearate, 240 g of a 10% aqueous poly(vinyl alcohol) solution and 55 g of water, and sufficient stirring was conducted to obtain a coating liquid. The coating liquid was coated on base paper having a basis weight of 60 g/m$^2$ in an amount of 7.5 g/m$^2$ in terms of solids and dried, and treatment by means of a super calender was carried out to obtain a thermal printing material.

EXAMPLES 2 TO 10

Thermal printing materials were obtained in the same manner as in Example 1, except that in place of methyl p-aminobenzoate, there was used each of propyl p-aminobenzoate (Example 2), iso-propyl p-aminobenzoate (Example 3), ethyl p-aminobenzoate (Example 4), m-aminoacetophenone (Example 5), p-aminoacetophenone (Example 6), o-aminobenzamide (Example 7), p-aminobenzamide (Example 8), p-(N-phenylcarbamoyl)aniline (Example 9), and p-[N-(4-chlorophenylcarbamoyl)]aniline (Example 10).

EXAMPLES 11 TO 13

Thermal printing materials were obtained in the same manner as in Example 1, except that in place of methyl p-aminobenzoate, there was used each of 5-acetylamino-2-methoxyaniline (Example 11), 4-acetylaminoaniline (Example 12), and 4-(N-methyl-N-acetylamino)aniline (Example 13).

EXAMPLES 14 TO 19

Thermal printing materials were obtained in the same manner as in Example 1, except that in place of methyl p-aminobenzoate, there was used each of 4-sulfamoylaniline (Example 14), sulfathiazole (Example 15), 2-methoxy-5-benzylsulfonylaniline (Example 16), 2-methoxy-5-N,N-diethylsulfamoylaniline (Example 17), 2,5-dimethoxy-4-N-phenylsulfamoylaniline (Example 18), and bis(3-aminophenyl) sulfone (Example 19).

EXAMPLE 20

A thermal printing material was obtained in the same manner as in Example 1, except that bis[4-(m-aminophenoxy)phenyl] sulfone was used in place of methyl p-aminobenzoate.

EXAMPLES 21 TO 22

Thermal printing materials were obtained in the same manner as in Example 1, except that in place of methyl p-aminobenzoate, there was used each of 2,2',5,5'-tetrachloro-4,4'-diaminodiphenyl (Example 21) and orthotolidine sulfone (Example 22).

EXAMPLES 23 TO 29

Thermal printing materials were obtained in the same manner as in Example 1, except that in place of methyl p-aminobenzoate, there was used each of 3,3'-diaminodiphenyl sulfone (Example 23), 4,4'-diaminodiphenyl sulfone (Example 24), 4,4'-diaminodiphenyl ether (Example 25), 4,4'-diamino-3,3'-dichlorodiphenylethane (Example 26), 4,4'-dithiodianiline (Example 27), 4,4'-thiodianiline (Example 28), and 1,3-bis(3-aminophenoxy)-benzene (Example 29).

COMPARATIVE EXAMPLE 1

A thermal printing material was obtained in the same manner as in Example 1, except that methyl p-aminobenzoate was omitted.

TEST 1 (DEPTH OF DEVELOPED COLOR)

Each of the thermal printing materials obtained in Examples 1 to 29 and Comparative Example 1 was subjected to printing under conditions of 3.0 millisecond in applied pulse and 16.00 volt in applied voltage by means of a thermal facsimile printing tester, and the density of the developed color images thus obtained was measured by means of densitometer Macbeth RD918. It is tabulated in Table 1 and Table 2.

TEST 2 (PLASTICIZER RESISTANCE)

Each of the thermal printing materials obtained in Examples 1 to 29 and Comparative Example 1 was placed on a vinyl chloride sheet and stored under load of 300 g/cm$^2$ in an atmosphere at 40° C. for 15 hours, after which the densities of color-developed portion and color-undeveloped portion were measured. They are tabulated in Table 1 and Table 2. The lower value of the density of color-undeveloped portion means the slighter fogging of the ground, namely, the more desirable condition.

TABLE 1

| | Test 1 (Depth of developed color) | Test 2 (Plasticizer resistance) Color-developed portion | Color-undeveloped portion |
|---|---|---|---|
| Example 1 | 0.97 | 0.99 | 0.17 |
| Example 2 | 1 03 | 1.03 | 0.20 |
| Example 3 | 0.98 | 1.02 | 0.19 |
| Example 4 | 1.01 | 1.02 | 0.17 |
| Example 5 | 0.93 | 0.93 | 0.18 |
| Example 6 | 1.00 | 1.03 | 0.16 |
| Example 7 | 0.88 | 0.92 | 0.14 |
| Example 8 | 0.80 | 0.86 | 0.11 |
| Example 9 | 0.84 | 0.90 | 0.09 |
| Example 10 | 0.87 | 0.95 | 0.10 |
| Example 11 | 0.80 | 0.84 | 0.07 |
| Example 12 | 0.80 | 0.85 | 0.08 |
| Example 13 | 0.81 | 0.85 | 0.09 |
| Example 14 | 0.86 | 0.92 | 0.15 |
| Example 15 | 0.81 | 0.87 | 0.13 |
| Example 16 | 0.85 | 0.91 | 0.13 |
| Example 17 | 0.87 | 0.90 | 0.10 |
| Example 18 | 0.83 | 0.88 | 0.19 |
| Example 19 | 0.85 | 0.89 | 0.12 |
| Example 20 | 0.81 | 0.85 | 0.09 |
| Example 21 | 0.82 | 0.87 | 0.15 |
| Example 22 | 0.80 | 0.84 | 0.15 |

TABLE 2

| | Test 1 (Depth of developed color) | Test 2 (Plasticizer resistance) Color-developed portion | Color undeveloped portion |
|---|---|---|---|
| Example 23 | 0.81 | 0.86 | 0.11 |
| Example 24 | 0.83 | 0.89 | 0.14 |
| Example 25 | 0.80 | 0.86 | 0.10 |
| Example 26 | 0.92 | 0.94 | 0.15 |
| Example 27 | 0.81 | 0.86 | 0.10 |
| Example 28 | 0.80 | 0.86 | 0.10 |
| Example 29 | 0.82 | 0.85 | 0.10 |
| Comparative Example 1 | 0.80 | 0.84 | 0.36 |

From Tables 1 and 2, it is clear that when the aniline derivative having at least one amino group according to this invention is used, not only the image storage properties but also the storage properties of color-undeveloped portion (ground) are excellent.

INDUSTRIAL APPLICABILITY

As described above, this invention is a thermal printing material having a thermal printing layer comprising an aromatic isocyanate compound and a specific imino compound which material possesses, in particular, improved storage properties of non-image portion (ground) by prevention of color development in this portion. Therefore, it is so useful that it is widely applicable in industrial fields requiring such a material, for example, in recorders for measurements, facsimiles, printers, terminals of computers, labels, and automatic ticket vending machines.

We claim:

1. A thermal printing material comprising a substrate and a thermal printing layer formed thereon comprising an aromaticity-possessing isocyanate compound, an imino compound having at least one >C=NH group which reacts with said aromaticity-possessing isocyanate compound on heating to produce color, and one or more aniline derivatives having at least one unsubstituted amino group.

2. A thermal printing material according to claim 1, wherein the aniline derivative having at least one unsubstituted amino group is a compound represented by the general formula:

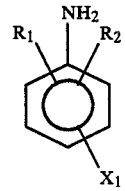

wherein each of $R_1$ and $R_2$ is hydrogen, an alkyl group, an alkoxyl group, a halogen or an amino group; and $X_1$ is

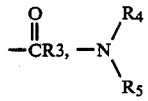

or $—SO_2R_6$ in which $R_3$ is a substituted or unsubstituted alkoxyl group, an aryl group, an alkyl group, a substituted or unsubstituted amino group, or a substituted or unsubstituted anilino group, each of $R_4$ and $R_5$ is hydrogen, an alkyl group, or

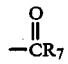

(wherein $R_7$ is an alkyl group or an aryl group), and $R_6$ is a substituted or unsubstituted amino group, a substituted or unsubstituted aryl group, a substituted or unsubstituted aryloxy group, or an aralkyl group.

3. A thermal printing material according to claim 2, wherein the aniline derivative having at least one amino group is a compound represented by the general formula:

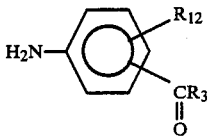

wherein $R_{12}$ is hydrogen, an alkyl group, an alkoxyl group or a halogen; and $R_3$ is a substituted or unsubstituted alkoxyl group, an aryl group, an alkyl group, a substituted or unsubstituted amino group, or a substituted or unsubstituted anilino group.

4. A thermal printing material according to claim 2, wherein the aniline derivative having at least one amino group is a compound represented by the general formula:

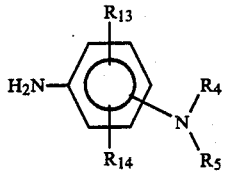

wherein each of $R_{13}$ and $R_{14}$ is hydrogen, an alkyl group or an alkoxyl group; and each of $R_4$ and $R_5$ is hydrogen, an alkyl group, or

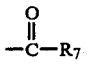

in which $R_7$ is an alkyl group or an aryl group.

5. A thermal printing material according to claim 2, wherein the aniline derivative having at least one unsubstituted amino group is a compound represented by the general formula:

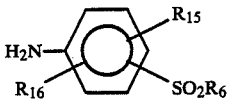

wherein $R_6$ is a substituted or unsubstituted amino group, an aryl group, a substituted or unsubstituted aryloxy group, or an aralkyl group; and each of $R_{15}$ and $R_{16}$ is hydrogen, a halogen, an alkyl group or an alkoxyl group.

6. A thermal printing material according to claim 5, wherein the aniline derivative is 2-methoxy-5-N,N-diethylsufamoylaniline.

7. A thermal printing material according to claim 5, wherein the general formula, $R_6$ is a substituted amino group; and each of $R_{15}$ and $R_{16}$ is hydrogen or an alkoxy group.

8. A thermal printing material according to claim 1, wherein the aniline derivative having at least one amino group is a compound represented by the general formula:

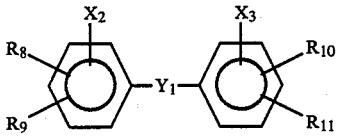

wherein each of $R_8$, $R_9$, $R_{10}$ and $R_{11}$ is hydrogen, a halogen, an alkyl group, an alkoxyl group or an amino group; each of $X_2$ and $X_3$ is an amino group, or

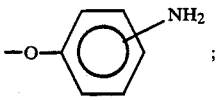

and $Y_1$ is $—SO_2—$, —O—, $—(S)_n—$, $—(CH_2)_n—$,

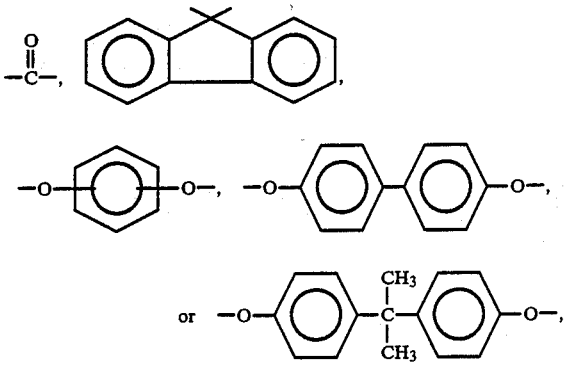

or indicates that nothing is present, n being 1 or 2.

9. A thermal printing material according to claim 8, wherein the aniline derivative having at least one amino group is a compound represented by the general formula:

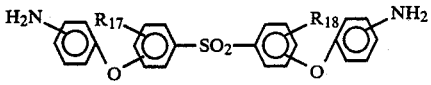

wherein each of $R_{17}$ and $R_{18}$ is hydrogen or an alkyl group.

10. A thermal printing material according to claim 8, wherein the aniline derivative having at least one amino group is a compound represented by the general formula:

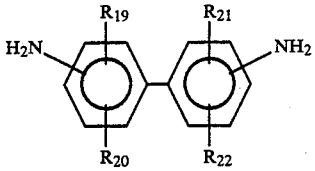

wherein each of $R_{19}$, $R_{20}$, $R_{21}$ and $R_{22}$ is hydrogen, a halogen, an alkoxyl group or an alkyl group, or $R_{19}$ and $R_{21}$, when taken together, may form a sulfonyl group.

11. A thermal printing material according to claim 8, wherein the aniline derivative having at least one amino group is a compound represented by the general formula:

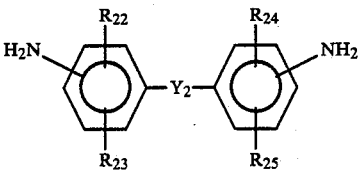

wherein each of $R_{22}$, $R_{23}$, $R_{24}$ and $R_{25}$ is hydrogen, a halogen, an alkyl group or an amino group; and $Y_2$ is —O—, $—(S)_n—$, $—(CH_2)_n—$,

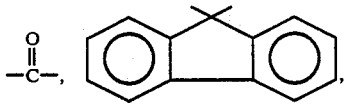

-continued

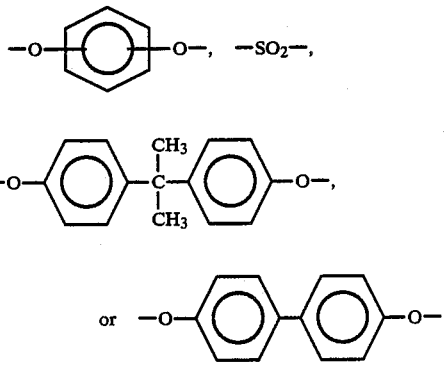

in which n is 1 or 2.

12. A thermal printing material according to claim 1, wherein the aniline derivative having at least one amino group is contained in an amount of 10 to 500% by weight based on the weight of the aromaticity-possessing isocyanate compound.

13. A thermal printing material according to claim 12, wherein the aniline derivative having at least one amino group is contained in an amount of 15 to 400% by weight based on the weight of the aromaticity-possessing isocyanate compound.

14. A thermal printing material according to claim 13, wherein the aniline derivative having at least one amino group is contained in an amount of 20 to 200% by weight based on the weight of the aromaticity-possessing isocyanate compound.

* * * * *